US012274344B1

(12) United States Patent
Peters et al.

(10) Patent No.: US 12,274,344 B1
(45) **Date of Patent: *Apr. 15, 2025**

(54) SINGLE BLADE NAIL CUTTER

(71) Applicant: edjy LLC, Ketchum, ID (US)

(72) Inventors: Jake Peters, Ketchum, ID (US); Chass Bakker, Dayton, MD (US); Tasche Streib, Hailey, ID (US); Braden Becker, Craftsbury, VT (US)

(73) Assignee: EDJY LLC, Ketchum, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/673,491

(22) Filed: May 24, 2024

Related U.S. Application Data

(63) Continuation of application No. 18/667,131, filed on May 17, 2024, which is a continuation-in-part of application No. 18/378,855, filed on Oct. 11, 2023, now Pat. No. 12,016,444.

(51) Int. Cl.
*A45D 29/02* (2006.01)

(52) U.S. Cl.
CPC ..... *A45D 29/023* (2013.01)

(58) Field of Classification Search
None
See application file for complete search history.

(56) References Cited

U.S. PATENT DOCUMENTS 1,363,164 A * 12/1920 Oesterwitz ..... A45D 29/02 30/28
1,394,727 A 10/1921 Gronbech
2,540,782 A 2/1951 Hansen
2,799,923 A 7/1957 Senshu
3,013,334 A 12/1961 Bassett
3,031,753 A 5/1962 Pocoski
3,031,754 A 5/1962 Pocoski
3,189,996 A 6/1965 Casey
3,744,131 A 7/1973 Manes
3,986,257 A 10/1976 Kiura
4,031,181 A 6/1977 Schaefer et al.
4,130,937 A 12/1978 Kim
4,402,407 A 9/1983 Maly
(Continued)

FOREIGN PATENT DOCUMENTS

JP 2003116626 A * 4/2003
JP 3121742 U * 5/2006
(Continued)

*Primary Examiner* — Hwei-Siu C Payer

(74) *Attorney, Agent, or Firm* — NORTON ROSE FULBRIGHT US LLP; Barry Greenbaum

(57) ABSTRACT

A nail cutter is provided that includes a blade and a unitary body. The blade includes a cutting edge. The unitary body includes a first member, a second member, a third member, and a plurality of flexible hinges. The blade extends from a proximal end of the first member. A proximal end of the second member is disposed opposite the cutting edge of the blade. The plurality of flexible hinges are configured such that, when a proximal end of the third member is transitioned from a first position to a second position, the unitary body flexes at the plurality of flexible hinges so as to decrease a distance between the cutting edge and the proximal end of the second member. Other aspects and features are also claimed and described.

20 Claims, 18 Drawing Sheets

(56) References Cited

U.S. PATENT DOCUMENTS

| | | | |
|---|---|---|---|
| 4,458,459 | A | 7/1984 | Irrgang |
| 4,550,496 | A | 11/1985 | Reinicke |
| 4,614,031 | A | 9/1986 | Chen |
| 4,640,011 | A | 2/1987 | Gamble |
| 4,648,415 | A | 3/1987 | Yuan |
| 4,847,994 | A | 7/1989 | Dunn, Jr. |
| 5,072,511 | A | 12/1991 | Ro |
| 5,185,980 | A | 2/1993 | Rydberg et al. |
| 5,195,544 | A | 3/1993 | Campagna |
| 5,533,262 | A | 7/1996 | Clark |
| 5,622,191 | A | 4/1997 | McMullen, Jr. et al. |
| 5,702,120 | A | 12/1997 | Malofsky et al. |
| 5,791,049 | A | 8/1998 | Dolev |
| 5,983,498 | A | 11/1999 | Lieberman et al. |
| 6,009,880 | A | 1/2000 | Weidlich |
| 6,088,919 | A | 7/2000 | Gilman |
| 6,220,251 | B1 | 4/2001 | Jeong et al. |
| 6,523,545 | B2 | 2/2003 | Rende |
| 6,553,592 | B2 | 4/2003 | Yang et al. |
| 6,557,259 | B1 | 5/2003 | Nguyen |
| 6,560,874 | B1 | 5/2003 | DeMezzo |
| 6,904,683 | B2 | 6/2005 | Shinoda et al. |
| 6,941,657 | B2 | 9/2005 | Choi et al. |
| 6,976,310 | B1 | 12/2005 | Sim |
| 7,000,321 | B1 | 2/2006 | Rodgers |
| 7,003,882 | B2 | 2/2006 | Sakai |
| 7,020,964 | B2 | 4/2006 | Han et al. |
| 7,210,230 | B2 | 5/2007 | Wurzel |
| 7,222,427 | B1 | 5/2007 | Kaidi et al. |
| 7,234,238 | B2 | 6/2007 | Wong |
| 7,263,775 | B2 | 9/2007 | Moulton, III |
| D554,289 | S | 10/2007 | Johnson et al. |
| 7,913,391 | B1 | 3/2011 | Eul |
| D639,510 | S | 6/2011 | Farris |
| 7,954,242 | B1 | 6/2011 | Brizan |
| 8,082,668 | B2 | 12/2011 | Samson |
| 8,096,053 | B2 | 1/2012 | Wong |
| 8,496,013 | B2 | 7/2013 | McCourtney |
| 8,640,319 | B2 | 2/2014 | McMullen, Jr. |
| 8,683,700 | B1 | 4/2014 | Kaidi et al. |
| 8,863,758 | B1 | 10/2014 | Walenciak |
| 8,984,754 | B1 | 3/2015 | Kaidi et al. |
| 10,076,173 | B1 | 9/2018 | Kaidi et al. |
| 12,016,444 | B1 * | 6/2024 | Peters ..... A45D 29/02 |
| 2005/0172488 | A1 | 8/2005 | Hartley |
| 2007/0067995 | A1 | 3/2007 | Alfaro |
| 2009/0211098 | A1 | 8/2009 | Childs, II |
| 2013/0067748 | A1 | 3/2013 | Hallowell |
| 2018/0295966 | A1 | 10/2018 | Zhang |

FOREIGN PATENT DOCUMENTS

| | | | | |
|---|---|---|---|---|
| JP | 2009247738 | A | | 10/2009 |
| JP | 2010069097 | A | * | 4/2010 |
| JP | 2013106788 | A | * | 6/2013 |
| JP | 2018008041 | A | | 1/2018 |
| KR | 200195565 | Y1 | | 9/2000 |
| TW | M272432 | U | | 8/2005 |

* cited by examiner

SINGLE BLADE NAIL CUTTER

CROSS-REFERENCE TO PRIOR APPLICATIONS

The present application is a continuation of U.S. patent application Ser. No. 18/667,131, filed May 17, 2024, which is a continuation-in-part of U.S. patent application Ser. No. 18/378,855, filed Oct. 11, 2023, now U.S. Pat. No. 12,016,444.

BACKGROUND

A nail clipper is a handheld grooming tool designed for trimming (e.g., clipping) and shaping fingernails and toenails. Typically, a nail clipper consists of a pair of blades and a lever mechanism for bringing the blades towards one another. Each of the blades are typically made of stainless steel and are designed to crush/tear through nails. As such, when a nail is positioned between the blades and the blades are brought towards one another, the blades crush/tear a portion of a nail.

SUMMARY

The present disclosure provides a new and innovative nail cutter and method for cutting nails, such as human nails. The present nail cutter has a single blade design that includes a first member having a blade opposite a second member having a blade-free opposing surface. The blade-free opposing surface bears a significant portion of the force required to cut a nail, which slows the dulling process for the blade. In some aspects, the blade-free opposing surface may be constructed of a material having a sufficiently low hardness to substantially mitigate dulling of the blade were it to come into contact with the blade-free opposing surface, which further slows the dulling process. In some aspects, the single blade design limits or prevents the blade from contacting the blade-free opposing surface via a recess and/or blade stop mechanism, which can even further slow the dulling process. The present nail cutter's single blade design additionally provides flexibility for the nail cutter to have other functions beyond supporting and cutting the nail, such as preventing nail bed separation or limiting how short the nail can be cut, by eliminating the opposing blade design's requirement that the opposing blades align closely with one another. Greater flexibility for materials selection for the nail cutter's various components is also afforded by the single blade design.

In an example, a nail cutter includes a first (e.g., cutting) member and a second (e.g., opposing) member. A first end portion of the cutting member includes a blade. The opposing member has a first end portion that does not include a blade and has a recess positioned to receive a cutting edge of the blade of the cutting member, and is coupled to the cutting member such that the cutting member is movable relative to the opposing member between first and second positions.

When the cutting member moves from the first position to the second position, the blade moves toward the first end portion of the opposing member such that the cutting edge of the blade is received within the recess, and without contacting any surface of the opposing member, both during the movement from the first position to the second position and during a resting position when the movement is complete and the cutting edge of the blade is received within the recess. A third member (e.g., lever) is coupled to the cutting member and is movable between third and fourth positions. The lever is configured to move the cutting member, relative to the opposing member, from the first position to the second position when the lever moves from the third position to the fourth position.

In an example, a method of cutting a nail of a human includes disposing the nail between a blade of a cutting member of a nail cutter and a first end portion of a opposing member of the nail cutter, wherein the first end portion of the opposing member does not include a blade; and moving the blade toward the first end portion of the opposing member while the nail is disposed between the blade and the first end portion of the second member such that the blade cuts the nail.

In some embodiments, the nail cutter includes a compliant mechanism having flexible hinge points, for example, a unitary design in which all components of the nail cutter are integral with one another. In some aspects, the blade may be a separate component that is coupled to the integral components of the nail cutter. In such embodiments, the lever is integral with the opposing member via a first flexible hinge. The opposing member includes the blade-free opposing surface that opposes the blade. The blade extends from the cutting member. The cutting member is integral with the opposing member via a second flexible hinge. The cutting member is further integral with a connecting member via a third flexible hinge. The connecting member is integral with the lever via a fourth flexible hinge.

When the lever is brought towards the opposing member, the unitary body flexes at all four flexible hinges such that the blade is brought towards the blade-free opposing surface. The configuration of the flexible hinges provides a mechanical advantage in that force at the blade is a multiplication of the force applied at the ends of the lever and opposing member.

Compared to typical nail clipper designs, the complaint mechanism of the nail cutter affords a decreased part count, less failure modes, greater tuneability of the compliant mechanism's behavior, and improved durability (e.g., relative moving parts in mechanical hinges wear out over time).

In an example, a nail cutter includes a blade including a cutting edge, and a unitary body. The unitary body includes: a first member, a second member, a third member, and a plurality of flexible hinges. The blade extends from a proximal end of the first member. A proximal end of the second member is disposed opposite the cutting edge of the blade. The plurality of flexible hinges are configured such that, when a proximal end of the third member is transitioned from a first position to a second position, the unitary body flexes at the plurality of flexible hinges so as to decrease a distance between the cutting edge and the proximal end of the second member.

In another example, a nail cutter includes a unitary body. The unitary body includes a first member, a second member, a third member, a fourth member, and a plurality of flexible hinges including a first flexible hinge, a second flexible hinge, a third flexible hinge, and a fourth flexible hinge. The second member is joined to the third member by the first flexible hinge. The first member is joined to the second member by the second flexible hinge. The fourth member is joined to the first member by the third flexible hinge. And the fourth member is joined to the third member by the fourth flexible hinge.

Additional features and advantages of the disclosed method and apparatus are described in, and will be apparent from, the following Detailed Description and the Figures. The features and advantages described herein are not all-inclusive and, in particular, many additional features and advantages will be apparent to one of ordinary skill in the art in view of the figures and description. Moreover, it should be noted that the language used in the specification has been principally selected for readability and instructional purposes, and not to limit the scope of the inventive subject matter.

BRIEF DESCRIPTION OF THE DRAWINGS

A further understanding of the nature and advantages of the present disclosure may be realized by reference to the following drawings. In the appended figures, similar components or features may have the same reference label. Further, various components of the same type may be distinguished by following the reference label by a dash and a second label that distinguishes among the similar components. If just the first reference label is used in the specification, the description is applicable to any one of the similar components having the same first reference label irrespective of the second reference label.

Like reference numbers and designations in the various drawings indicate like elements.

DETAILED DESCRIPTION

Figure 1:
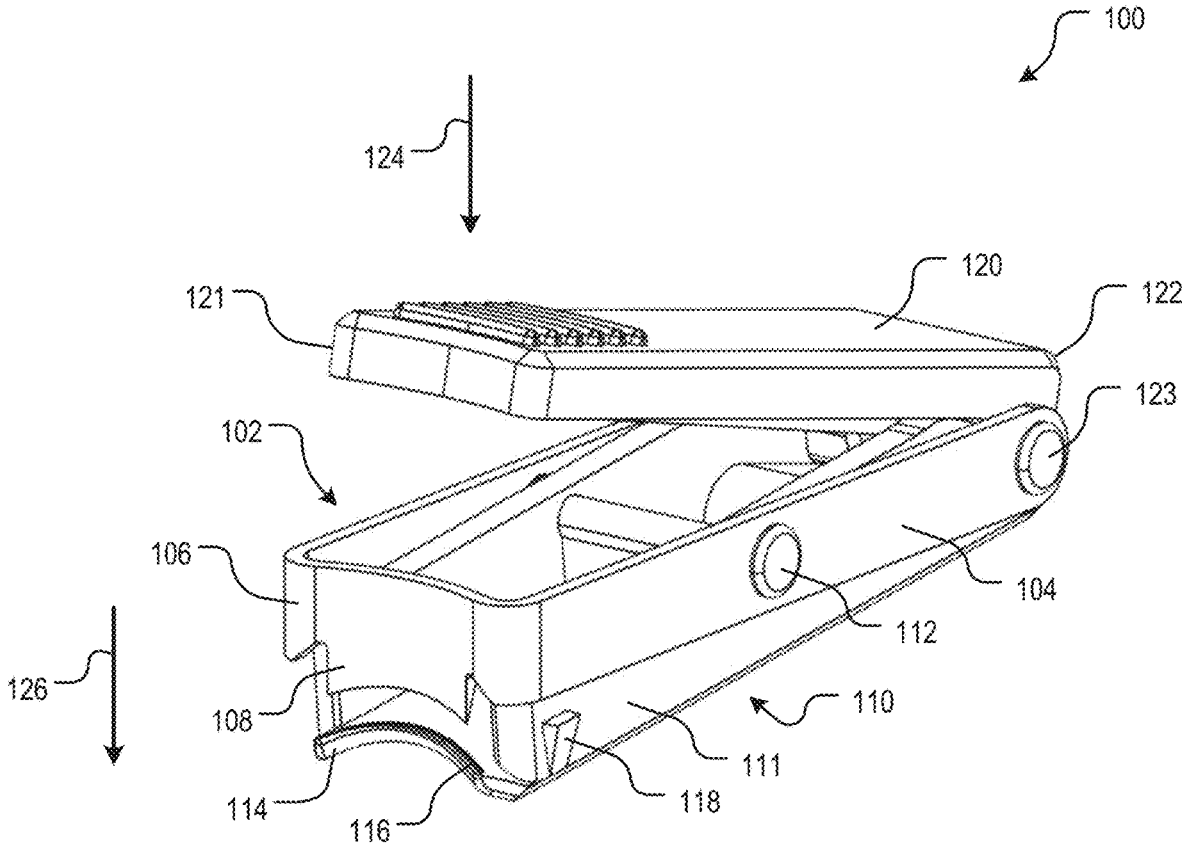
FIG. 1 illustrates a perspective view of a nail cutter, according to an aspect of the present disclosure.

The detailed description set forth below, in connection with the appended drawings, is intended as a description of various configurations and is not intended to limit the scope of the disclosure. Rather, the detailed description includes specific details for the purpose of providing a thorough understanding of the inventive subject matter. It will be apparent to those skilled in the art that these specific details are not required in every case.

A nail clipper typically consists of a pair of opposing blades and a lever mechanism for bringing the blades towards one another. With this design, the opposing blades apply opposing forces to a nail during a nail clipping operation and thereafter contact one another after the nail is clipped, which can lead to one or both of the opposing blades dulling or bending. As the opposing blades become more dull with continued usage, greater energy (e.g., force) must be applied to the lever mechanism for the opposing blades to cut through the nail. With a dull blade, a considerable portion of this energy is stored and released upon final separation of the distal nail edge, causing the blades to contact one another with significant force and audible "click" which further expedites the dulling process. The force required between the opposing blades also contributes to a rougher cutting edge of a nail, and higher velocity of expelled nail clippings.

The present nail cutter, on the other hand, has a single blade design that includes a first member having a blade opposite a second member having a blade-free opposing surface, which addresses at least the above shortcomings of a typical nail clipper. For example, the blade-free opposing surface bears a significant portion of the force required to cut a nail rather than the blade's cutting edge, which slows the dulling process for the blade. In some aspects, the blade-free opposing surface may be constructed of a material having a sufficiently low hardness to substantially mitigate dulling of the blade were it to come into contact with the blade-free opposing surface, which further slows the dulling process. In some aspects, the single blade design limits or prevents the blade from contacting the blade-free opposing surface, which can even further slow the dulling process. The present nail cutter's single blade design additionally provides flexibility for the nail cutter to have other functions beyond supporting and cutting the nail, such as preventing nail bed separation or limiting how short the nail can be cut, by eliminating the opposing blade design's requirement that the opposing blades align closely with one another. Greater flexibility for materials selection for the nail cutter's various components is also afforded by the single blade design.

In some embodiments, the nail cutter may include a compliant mechanism having flexible hinge points, for example, a unitary body in which all components of the unitary body are integral with one another. The blade may be integral with the unitary body or may be a separate component that is coupled to the unitary body. In such embodiments, the nail cutter includes a lever that is integral with an opposing member via a first flexible hinge. The opposing member includes a blade-free opposing surface that opposes the blade. The blade extends from a cutting member. The cutting member is integral with the opposing member via a second flexible hinge. The cutting member is further integral with a connecting member via a third flexible hinge. The connecting member is integral with the lever via a fourth flexible hinge. When the lever is brought towards opposing member, the unitary body flexes at all four flexible hinges such that the blade is brought towards the blade-free opposing surface.

Compared to typical nail clipper designs, the complaint mechanism of the nail cutter affords a decreased part count, less failure modes, greater tuneability of the compliant mechanism's behavior, and improved durability (e.g., relative moving parts in mechanical hinges wear out over time).

These advantages of the present nail cutter, as well as other advantages, will be apparent to one having ordinary skill in the art by the following description of the figures.

Shortcomings mentioned here are only representative and are included to highlight problems that the inventors have identified with respect to existing nail cutters and sought to improve upon. Aspects of the nail cutter described below may address some or all of the shortcomings as well as others known in the art. Aspects of the improved nail cutter described herein may present other benefits than, and be used in other applications than, those described above and below.

Figure 5A:
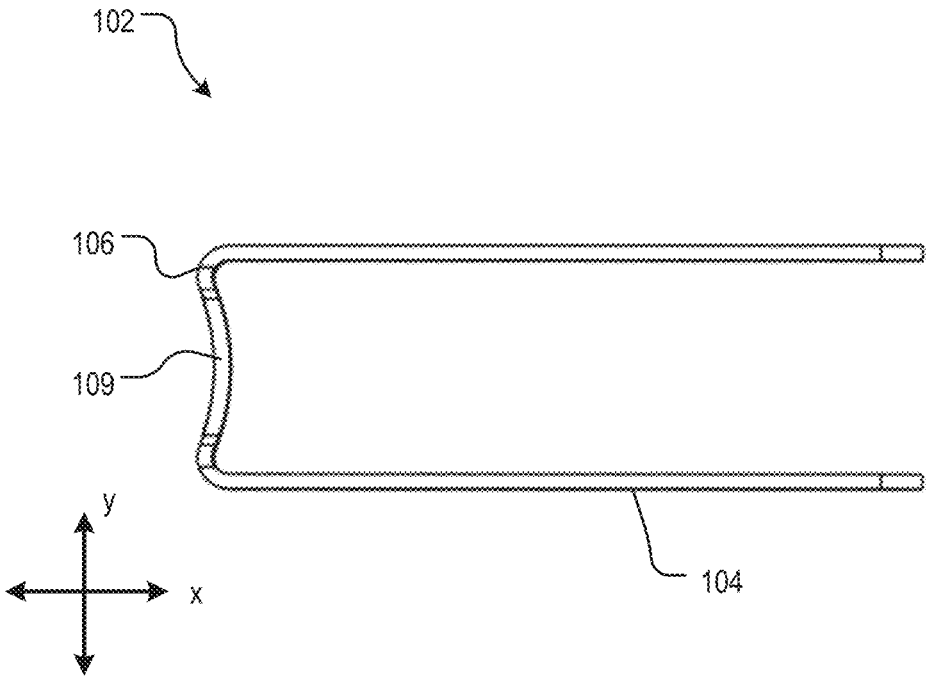
FIG. 5A illustrates a top view of a blade of the nail cutter of FIG. 1, according to an aspect of the present disclosure.
Figure 5B:
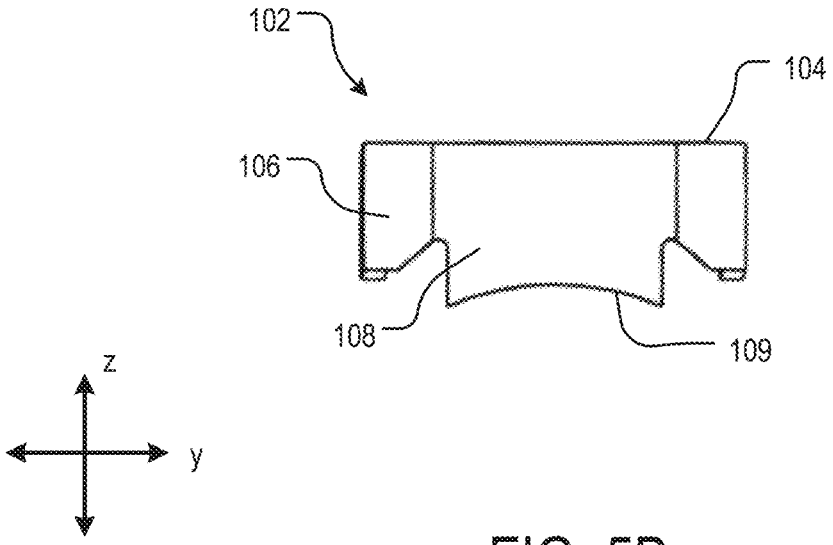
FIG. 5B illustrates a front-facing view of the blade of FIG. 5A, according to an aspect of the present disclosure.

FIGS. 1-4 illustrates various views of an example nail cutter 100 capable of cutting nails (e.g., human nails). Nail cutter 100 includes a cutting member 102 (e.g., a first member). Cutting member 102 includes a body 104 and a blade 108. Blade 108 is disposed at a first end portion 106 of cutting number 102. First end portion 106 is opposite a second end portion 107 of cutting member 102. In some aspects, blade 108 may be integral with body 104. In other aspects, blade 108 may be a separate component that is coupled to body 104. Blade 108 includes a cutting edge 109 that is sufficiently sharp to cut through a nail. The cutting edge 109 may have a curvature that anatomically aligns with a human nail. For example, as shown in FIG. 5A, cutting edge 109 may be curved in a first direction, such as by having a (radius of) curvature in the xy-plane. Cutting edge 109 anatomically aligns with a human nail's longitudinal curvature (e.g., the curvature at the nail tip) in this example. The longitudinal curvature is the curvature of the nail from a top view of the hand (perpendicular to the palm) in the direction of nail growth. The z-axis in FIG. 5A is into and out of the page. In another example, as shown in FIG. 5B, cutting edge 109 may be curved in a second direction that is perpendicular to the first direction, such as by having a (radius of) curvature in the yz-plane. Cutting edge 109 anatomically aligns with a human nail's transverse curvature (e.g., the curvature of the whole nail) in this example. The transverse curvature is the curvature of the nail perpendicular to the direction of nail growth (end-on view of the finger). The x-axis in FIG. 5B is into and out of the page. In some aspects, cutting edge 109 may be curved in both the first direction and the second direction. In such aspects, cutting edge 109 anatomically aligns with both the longitudinal curvature and the transverse curvature of a human nail.

Figure 2:
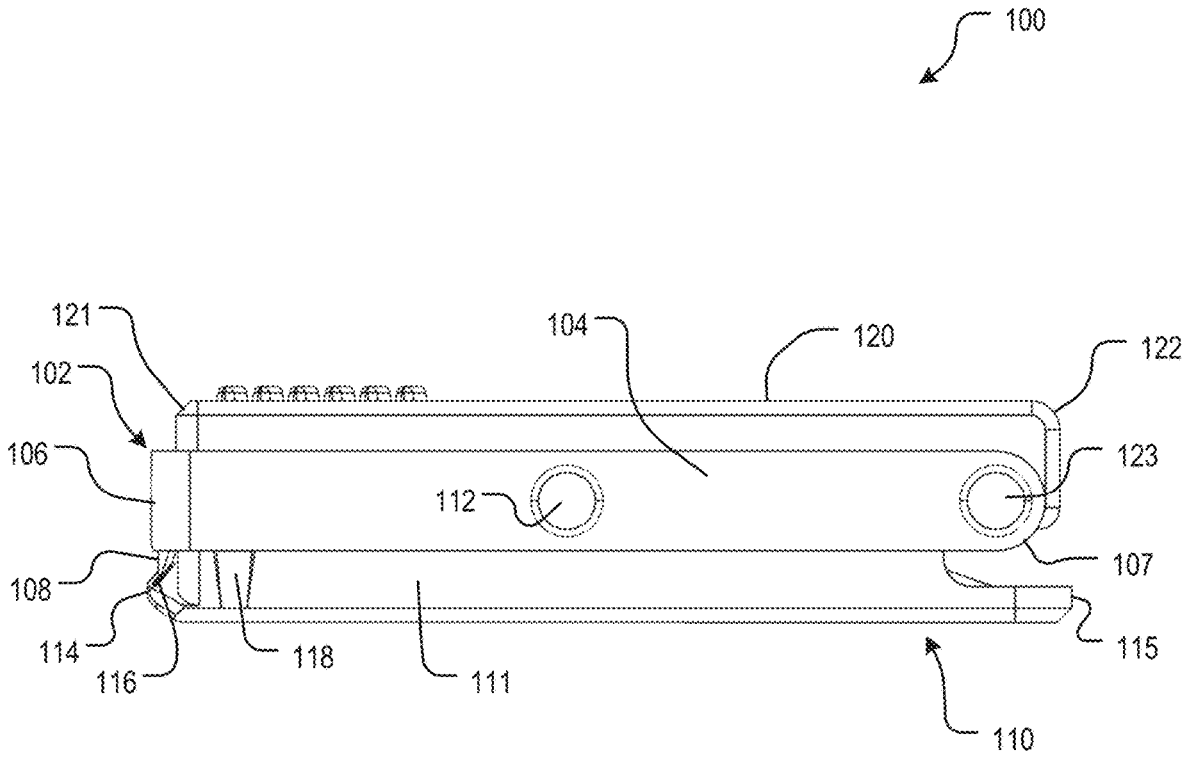
FIG. 2 illustrates a side view of the nail cutter of FIG. 1 in a closed position, according to an aspect of the present disclosure.

Returning to FIGS. 1-4, nail cutter 100 further includes an opposing member 110 (e.g., a second member) which may be a nail support platform. Opposing member 110 includes a body 111 having a first end portion 114 opposite a second end portion 115. Opposing member 110 does not include a blade but rather serves as a nail support platform. For instance, first end portion 114 of body 111 does not include a blade. Opposing member 110 is coupled to cutting member 102 such that cutting member 102 is movable relative to opposing member 110 between first and second positions. For example, opposing member 110 may be coupled to cutting member 102 by a pivot pin 112. Pivot pin 112 may be positioned as shown through openings 400A and 400B of cutting member 102 and openings 400E and 400F of opposing member 110. When cutting member 102 moves from the first position to the second position, blade 108 moves toward the first end portion 114 of opposing member 110. For instance, FIG. 1 shows an example of cutting member 102 being in the first position, which is any position in which blade 108 is sufficiently separated from first end portion 114 to allow a nail to be positioned between blade 108 and first end portion 114. FIG. 2 shows an example of cutting member 102 being in the second position in which blade 108 is nearer to first end portion 114 than when blade 108 is in the first position. For example, blade 108 may be in the second position while blade 108 is cutting through a nail or immediately after blade 108 cuts through the nail.

Figure 8:
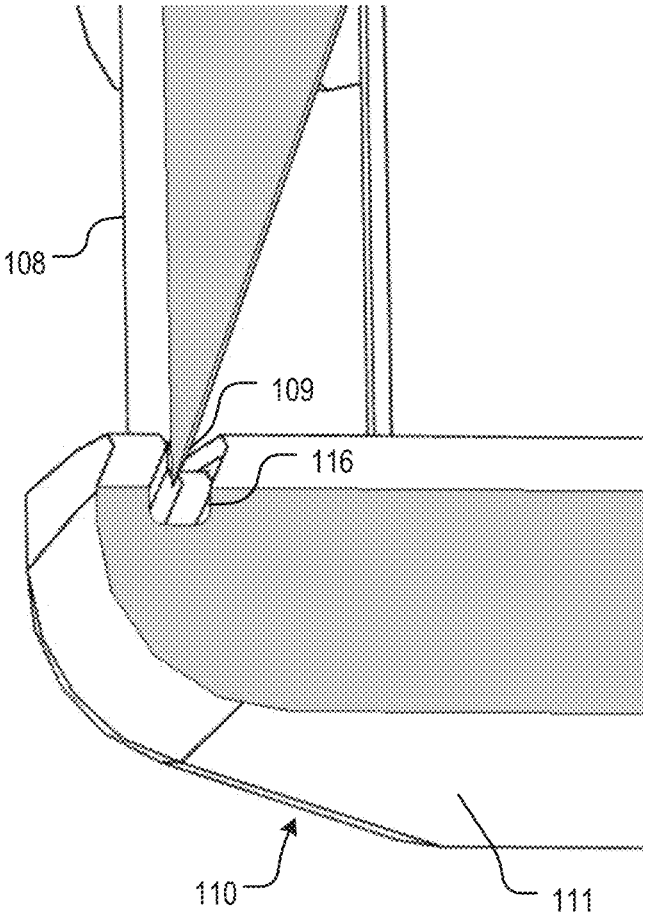
FIG. 8 illustrates a magnified cross-sectional view of the nail cutter of FIG. 1, according to an aspect of the present disclosure

In at least some aspects, the first end portion 114 of opposing member 110 includes a recess 116. Recess 116 may prevent any and all contact between cutting edge 109 of blade 108 and any portion and/or surface of opposing member 110. Recess 116 may also prevent any and all contact between cutting edge 109 of blade 108 and any portion and/or surface of any component or member situated within recess 116 or above opposing member 110. In such aspects, recess 116 is shaped and positioned to receive cutting edge 109 of blade 108 when cutting member 102 is in the second position. For example, FIG. 8 shows cutting edge 109 positioned within recess 116. Cutting edge 109 and recess 116 may be aligned such that cutting edge 109 does not contact any portion and/or surface of opposing member 110 that forms recess 116 when cutting edge 109 is received within recess 116. For example, recess 116 may have a curvature matching the curvature of cutting edge 109. Reducing or eliminating contact between cutting edge 109 and opposing member 110 via recess 116 slows the dulling process of cutting edge 109 and increases the service life of both cutting edge 109 as well as opposing member 110.

Typical nail clipper designs having opposing blades utilize a common material for a majority of the nail cutter. The common material must therefore meet functional and manufacturing requirements for both the opposing blades and the lever mechanism. The blade-free nature of opposing member 110 and/or the existence of recess 116, on the other hand, affords greater flexibility of the materials used for nail cutter 100. For example, blade 108 may include, or be constructed entirely of, a first material that is different than a second material which opposing member 110 includes or is constructed entirely of. Body 104 of cutting member 102 may include, or be constructed entirely of, the same material as blade 108 or a different material than blade 108. In some aspects, the first material of blade 108 has a greater hardness than the second material of opposing member 110. For example, the first material of blade 108 may have a greater hardness than the blade materials of typical nail clippers because nail cutter 100 eliminates the blade-to-blade contact, and blade to opposing surface contact due to, for example, recess 116, that higher hardness materials are unsuited to withstand. Higher hardness blades improve nail edge retention when nails are cut.

In some aspects, the hardness of the first material of blade 108 is at least 55 HRC on the Rockwell Scale of Hardness, part C. For example, the hardness of the first material of blade 108 may be within a range of 55 to 65 HRC. In comparison, typical opposing blade design nail clippers have blades with a hardness of 48 HRC in order to withstand the blade-to-blade contact and provide sufficient compliance for the mechanism to flex as the lever is depressed. The first material of blade 108 may include a metal (e.g., steel) or other suitably hard material. For example, the first material of blade 108 may include steel, which may have a hardness within a range of 61-62 HRC. Opposing member 110 may be constructed of a material having a sufficiently low hardness to substantially mitigate dulling of blade 108 were blade 108 to come into contact with opposing member 110. In various aspects, the second material of opposing member 110 may include a polymeric material. In one example, the polymeric material may be resin. The first end portion 114 of opposing member 110 may include or may be entirely composed of resin. Alternatively, the second material of opposing member 110 may include glass-filled nylon.

Figure 3:
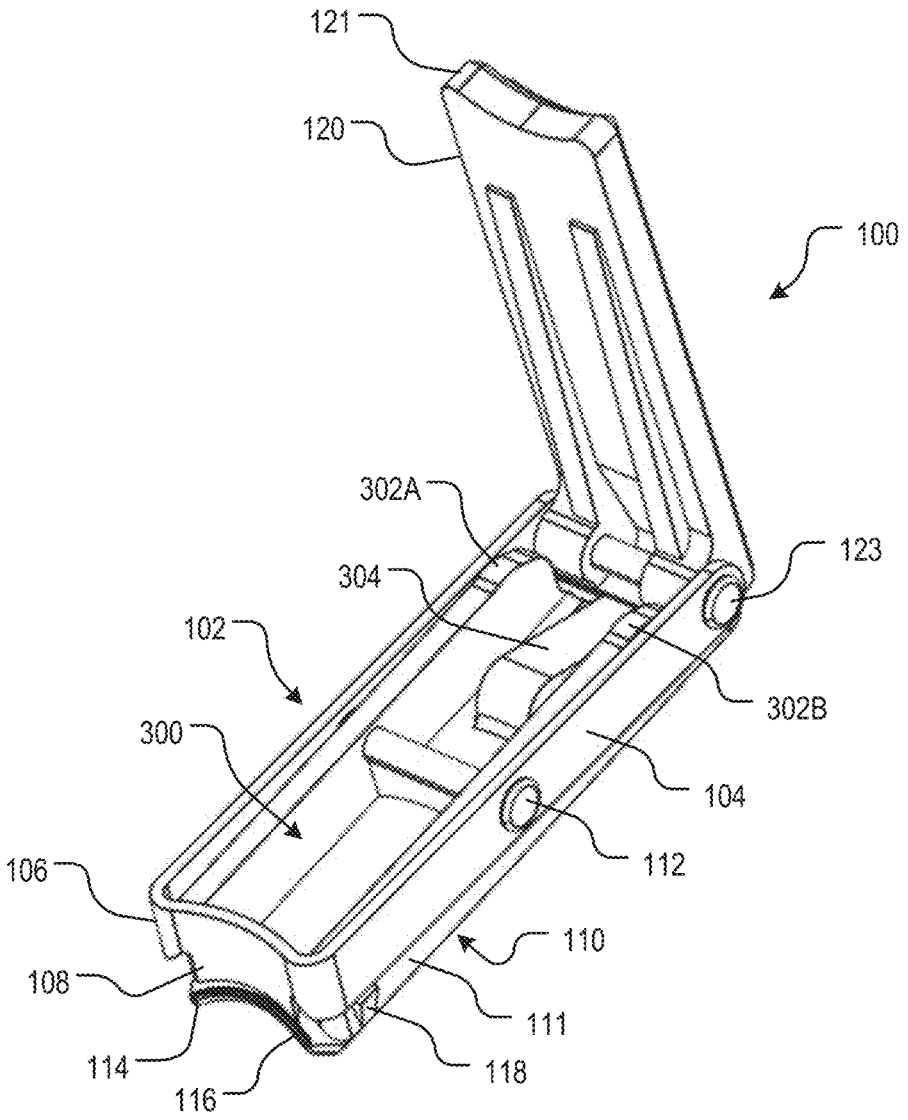
FIG. 3 illustrates a perspective view of the nail cutter of FIG. 1 in an open position, according to an aspect of the present disclosure.
Figure 4:
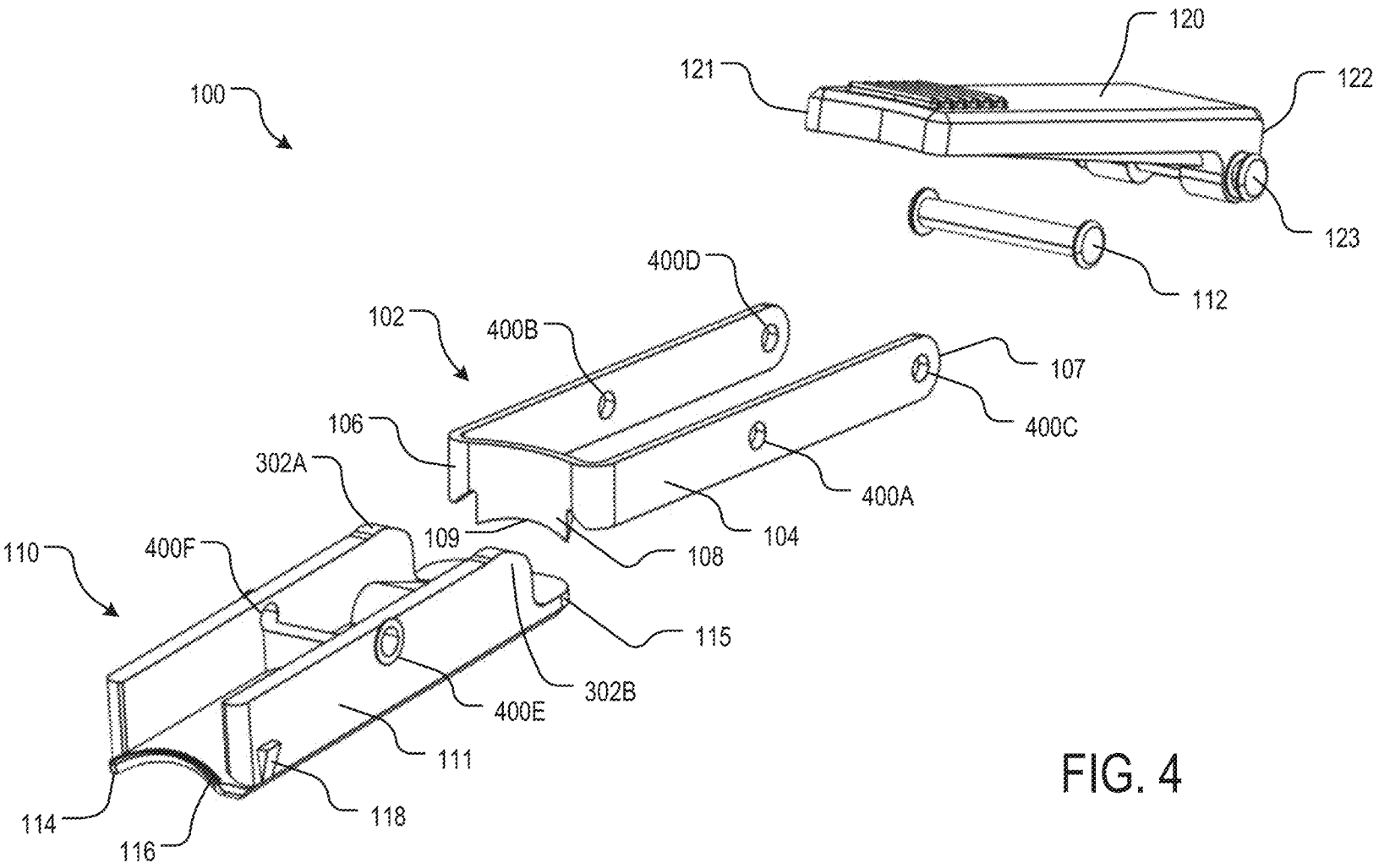
FIG. 4 illustrates an exploded view of the nail cutter of FIG. 1, according to an aspect of the present disclosure.

Returning to FIGS. 1-4, nail cutter 100 further includes a lever 120 (e.g., a third member). Lever 120 includes a first end portion 121 opposite a second end portion 122 and is coupled to cutting number 102 such that lever 120 is movable between third and fourth positions. For example, second end portion 122 of lever 120 may be coupled to second end portion 107 of cutting member 102 via a pivot pin 123. Pivot pin 123 may be positioned through openings 400C and 400D of cutting member 102 and respective openings of lever 120. Lever 120 can also be considered to be coupled to opposing member 110 by way of being coupled to cutting member 102, which is coupled to opposing member 110. FIGS. 1 and 3 each show examples of lever 120 being in a third position (FIG. 1 showing a cutting position while FIG. 3 showing an open/emptying position) whereas FIG. 2 shows an example of lever 120 being in a fourth position. The mechanism is tuned such that the normal/cutting position of the lever and the open/emptying position are two stable positions and energy input is required to go from one to the other. This is achieved by tuning the motion of the rearward pin which has a force exerted on it by the spring. The pin is lower in these two lever positions than it is between them. Nail cutter 100 is structured such that when the lever 120 is moved from the third position to the fourth position, cutting member 102 is moved, relative to the opposing member 110, from the first position to the second position. For example, as a user presses on the lever 120 with a force component in the direction of arrow 124, a point is reached when lever 120 forces blade 108 to move towards the first end portion 114 of opposing member 110 in the direction of arrow 126. Prior to the point being reached, lever 120 can pivot about the axis of pivot pin 123 without causing blade 108 to move towards or away from the first end portion 114 of opposing member 110.

The third position of lever 120 may be any position of lever 120 in which pressing on lever 120 with a force component in the direction of arrow 124 does not cause motion of blade 108 or causes motion of blade 108, but while blade 108 is the first position. For example, lever 120 may be in the third position prior to blade 108 cutting through a nail. The fourth position of lever 120 may be any position of lever 120 in which pressing on lever 120 with a force component in the direction of arrow 124 causes blade 108 to be in the second position. For example, lever 120 may be in the fourth position while blade 108 is cutting through a nail or immediately after blade 108 cuts through the nail.

Figure 6:
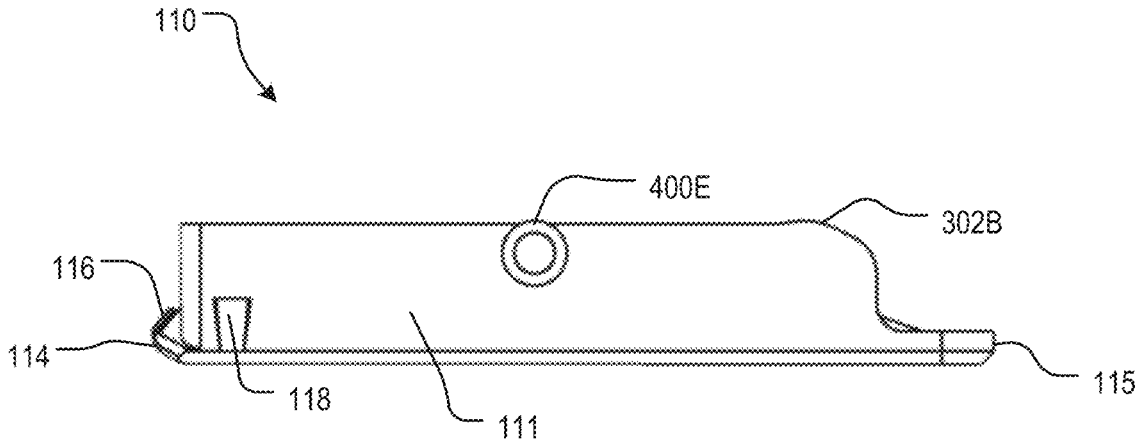
FIG. 6 illustrates a side view of a lower member of the nail cutter of FIG. 1, according to an aspect of the present disclosure.

Nail cutter 100 is structured such that force for a nail cutting operation is applied to lever 120 closer to the first end portion 121 than the second end portion 122. Stated differently, the pivot point of lever 120 is further from blade 108 than a point of lever 120 on which force is applied for a nail cutting operation. In this way, lever 120 is coupled to cutting member 102 such that the first end portion 121 of lever 120 moves towards the first end portion 114 of opposing member 110 while lever 120 moves from the third position to the fourth position. Limiting the span between where the user controls lever 120 for a nail cutting operation and where the cutting action takes place results fine control of blade 108 position and precise cuts. In at least some aspects, opposing member 110 includes at least one fulcrum on which lever 120 pivots as lever 120 is pressed to move first end portion 121 towards a first end portion 114 of opposing member 110. For example, opposing member 110 may include fulcrums 302A, 302B. FIG. 6 shows a side view of fulcrum 302B that extends above the portion of body 111 between opening 400E and fulcrum 302B. Lever 120 can be pivoted such that contact between lever 120 and fulcrums 302A, 302B can be severed. Pivoting lever 120 in this way enables greater access to a compartment 300 formed by opposing member 110, which will be described further below.

Another advantage of the single blade design of the nail cutter 100 is the tunable pivot ratios that the single blade design affords. For example, nail cutter 100 can be manufactured with various dimensions that effectuate various mechanical properties. For example, any of the following distances can be altered so that nail cutter 100 displays different mechanical properties: a distance between blade 108 and pivot pin 112, a distance between pivot pin 112 and pivot pin 123, a distance between pivot pin 123 and fulcrums 302A, 302B, and a distance between fulcrums 302A, 302B and the portion of lever 120 where force is applied.

Figure 7:
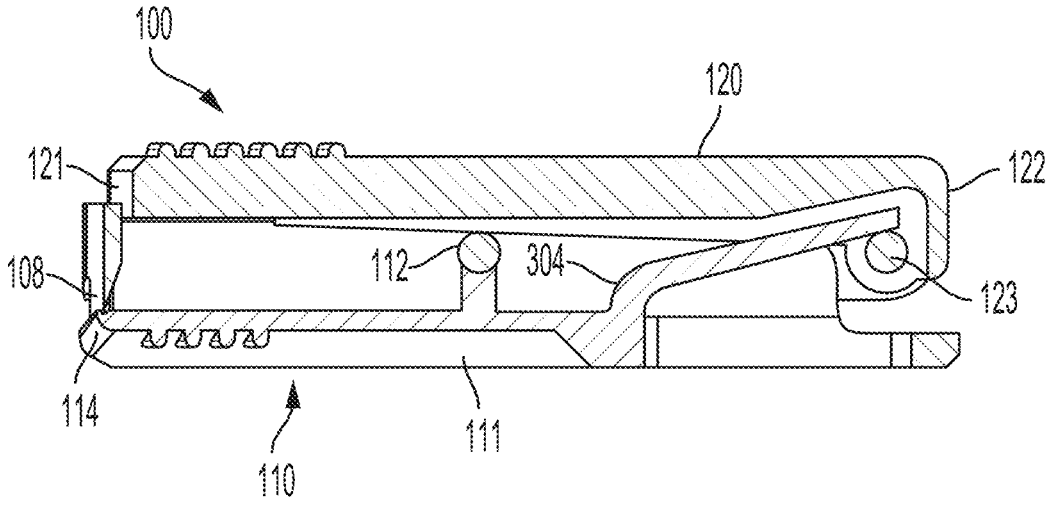
FIG. 7 illustrates a cross-sectional view of the nail cutter of FIG. 1 showing a cutting edge of the nail cutter's blade within a recess, according to an aspect of the present disclosure.

In various aspects, nail cutter 100 includes a biasing mechanism that biases lever 120 away from the fourth position and towards the third position. For example, opposing member 110 may include a biasing member 304, which may include a metal (e.g., steel) or other suitably hard material. Alternatively, biasing member 304 may include a polymeric material such as resin. Alternatively, the polymeric material may be a glass-filled nylon. As best shown in FIG. 7, biasing member 304 rests atop pivot pin 123 such that biasing member 304 may apply a force in a direction away from lever 120 to pivot pin 123. By applying this force to pivot pin 123, biasing member 304 urges pivot pin 123 towards the second end portion 115 of opposing member 110, which urges the first end portion 121 of lever 120 away from the first end portion 114 of opposing member 110. In this way, the first end portion 121 of lever 120 can spring away from the first end portion 114 of opposing member 110 once a nail is cut. In instances in which lever 120 is oriented substantially perpendicular to opposing member 110, biasing member 304 does not apply biasing force to pivot pin 123.

To help slow the pace of cutting edge 109 dulling, nail cutter 100 can include a mechanism that prevents cutting edge 109 from traveling too far and contacting at least the far end of the recess 116 of opposing member 110. In various aspects, the mechanism prevents cutting edge 109 from contacting any surface of recess 116. For example, FIGS. 1-4 show opposing member 110 including a stop 118 extending out from body 111. An identical, or at least similar, stop may be positioned on the opposite side of opposing member 110 that is not visible in FIGS. 1-4. Stop 118 is structured such that as blade 108 is moved towards the first end portion 114 of opposing member 110, body 104 of cutting member 102 contacts stop 118 before cutting edge 109 contacts recess 116. In this way, stop 118 prevents cutting edge 109 from contacting opposing member 110.

As previously stated, opposing member 110 forms compartment 300. Nail clippings are collected within compartment 300 as nails are cut by cutting edge 109 of blade 108. In at least some aspects, lever 120 is movable to a fifth position in which lever 120 is releasably coupled to opposing member 110 and overlies the compartment 300. Lever 120 thereby acts as a lid in the fifth position to contain the nail clippings within compartment 300. In this way, lever 120 may act as both a lever used to actuate the nail cutting operation and a lid to secure nail clippings. This described dual function of lever 120 reduces part count and design complexity.

Figure 9:
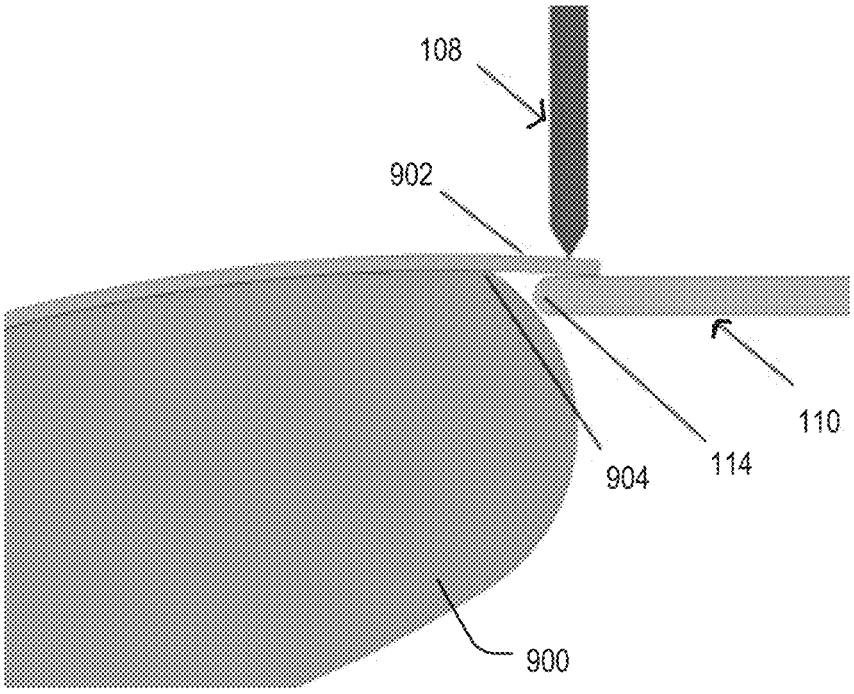
FIG. 9 illustrates a schematic of a nail being cut by the nail cutter of FIG. 1, according to an aspect of the present disclosure.

FIG. 9 shows a schematic of a nail 902 of a finger 900 being cut by nail cutter 100. Only blade 108 and a portion of opposing member 110 of the nail cutter 100 are shown for simplicity. In various aspects, a distance between a leading edge of the first end portion 114 and recess 116 of the first end portion 114 may be such that the first end portion 114 of opposing member 110 limits how short nail 902 can be cut. This distance as well as a shape of the leading edge of the first end portion 114 and/or angle of the blade can also mitigate separation of the nail 902 from a nail bed 904 of finger 900.

Figure 10:
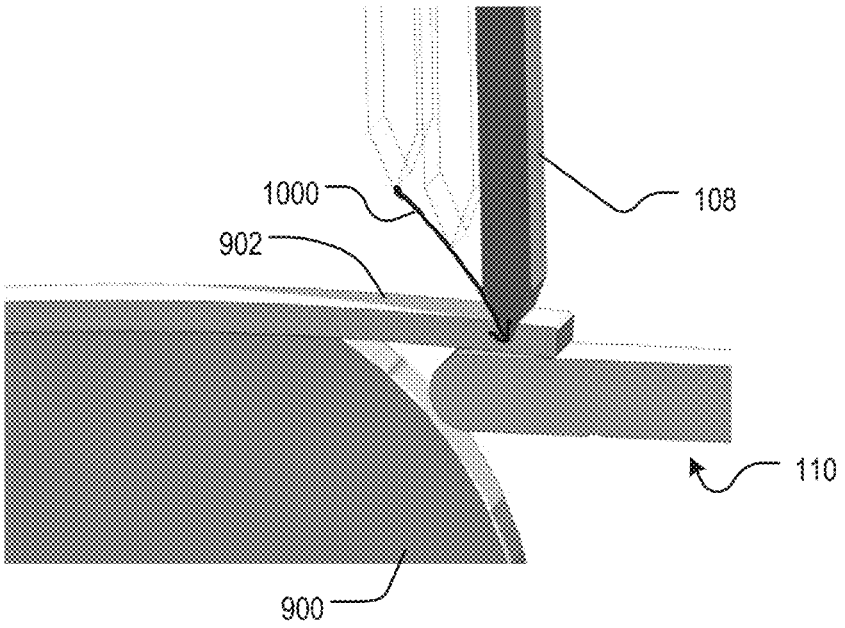
FIG. 10 illustrates a schematic of a cutting path of a blade of the nail cutter of FIG. 1, according to an aspect of the present disclosure.

In some aspects, nail cutter 100 may be structured such that cutting edge 109 of blade 108 cuts through a nail with a curved cutting path. Typical opposing blade nail clipper designs include the opposing blades traveling in a substantially co-linear path with the blade cutting edges being oriented perpendicular to a nail during a nail cutting operation. Such designs result in a less favorable cut of about 90° on the end of the nail. The curved cutting path of nail cutter 100, on the other hand, provides a more favorable cut edge of less than 90° on the edge of the nail. For example, FIG. 10 shows one example of a curved cutting path 1000 through which blade 108 travels during a nail cutting operation. In aspects with the curved cutting path 1000, blade 108 is disposed further from second end portion 115 of opposing member 110 when the cutting member 102 is in the second position than when cutting member 102 is in the first position.

In some embodiments, the mechanical pivot pins 112, 123 of nail cutter 100 may be replaced by a compliant mechanism having flexible hinge points, for example, a unitary design aspect of nail cutter 100 in which all components of nail cutter 100, besides blade 108, are integral with one another. Alternatively, all of the components of nail cutter 100 are integral with one another. Compared to typical nail clipper designs, the complaint mechanism aspects of nail cutter 100 affords a decreased part count, less failure modes, greater tuneability of the compliant mechanism's behavior, and improvement durability (e.g., relative moving parts in mechanical hinges wear out over time).

Figure 12:
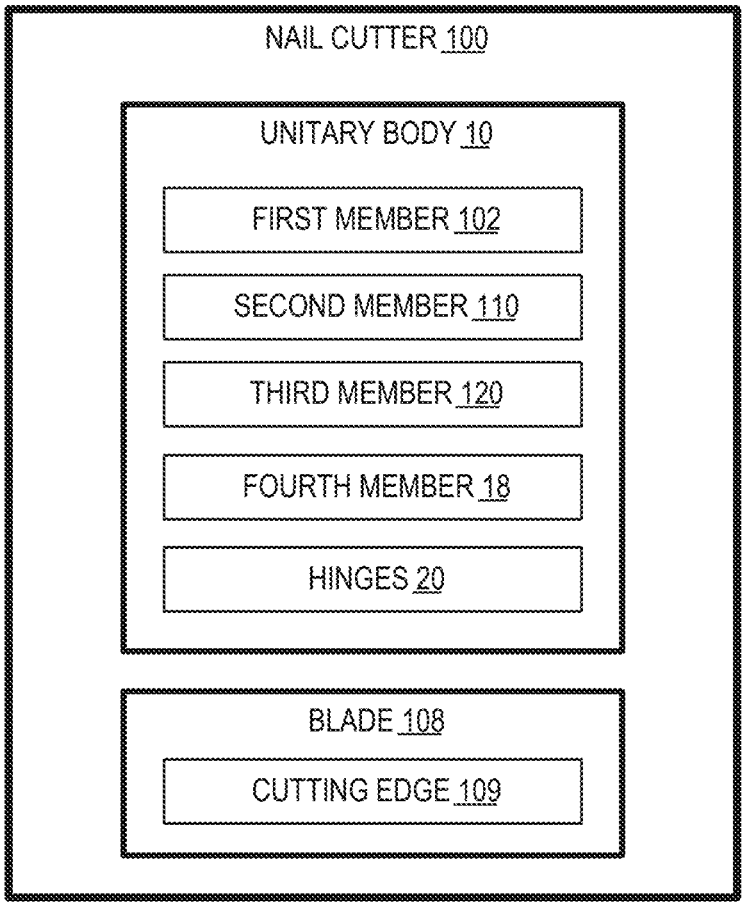
FIG. 12 is a box diagram of the nail cutter including a complaint mechanism, according to an aspect of the present disclosure.

FIG. 12 is a box diagram of nail cutter 100 having a compliant mechanism. Only the differences between nail cutter 100 having the compliant mechanism and nail cutter 100 having the mechanical pivot pins 112, 123 will be described. Nail cutter 100 includes a unitary body 10. The unitary body 10 includes first (e.g., cutting) member 102, second (e.g., opposing) member 110, third member (e.g., lever) 120, a fourth (e.g., connecting) member 18, and a plurality of flexible hinges 20. The plurality of flexible hinges 20 are integral with the cutting member 102, opposing member 110, lever 120, and connecting member 18 such that the unitary body 10 is a single, integral component. For example, lever 120 is integral with opposing member 110 via a first flexible hinge. The cutting member 102 is integral with the opposing member 110 via a second flexible hinge. The cutting member 102 is further integral with connecting member 18 via a third flexible hinge. The connecting member 18 is integral with lever 120 via a fourth flexible hinge.

Nail cutter 100 further includes blade 108 that includes cutting edge 109. In some aspects, blade 108 may be integral with unitary body 10 such that nail cutter 100 is a single, integral component. In other aspects, blade 108 may be coupled to unitary body 10.

Figure 13:
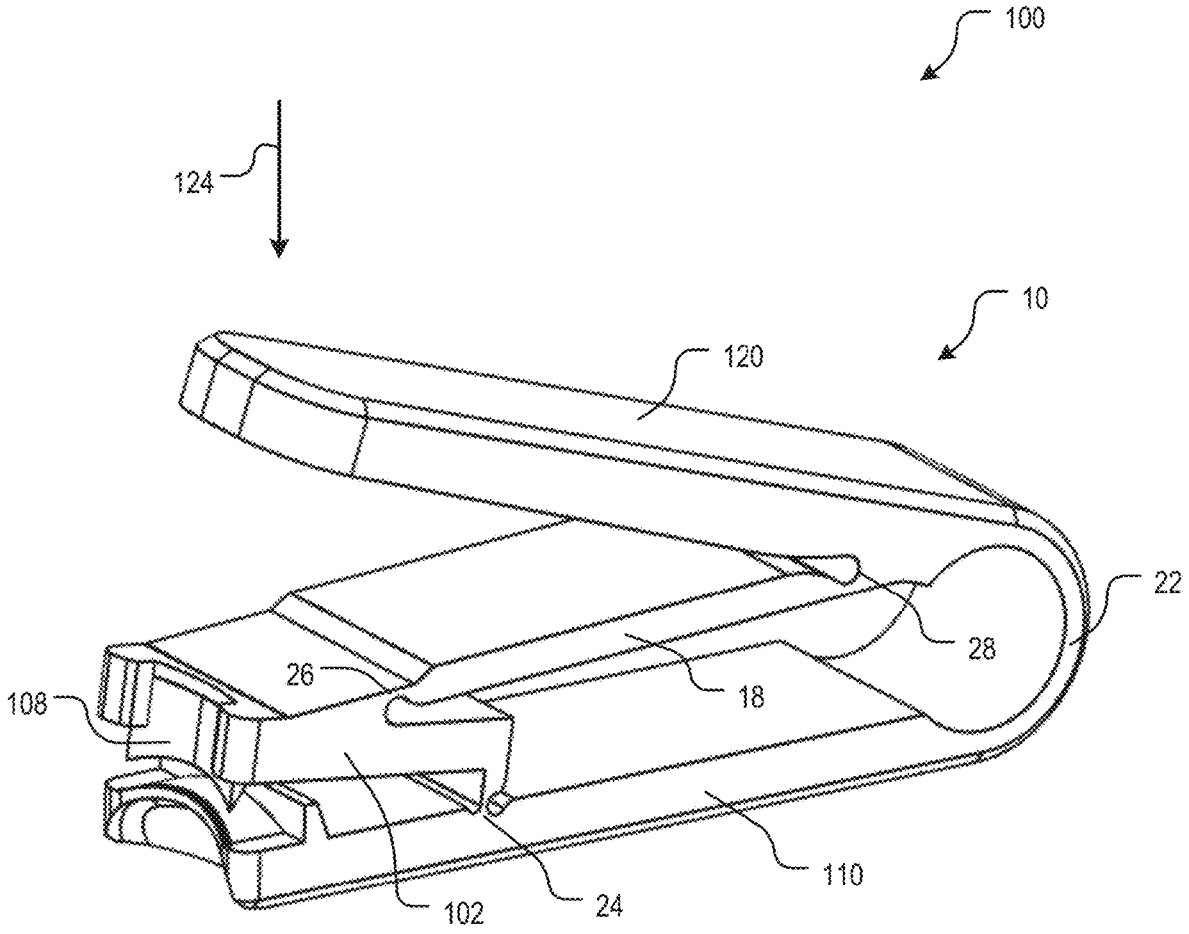
FIG. 13 illustrates a perspective view of the nail cutter including the complaint mechanism, according to an aspect of the present disclosure.
Figure 14A:
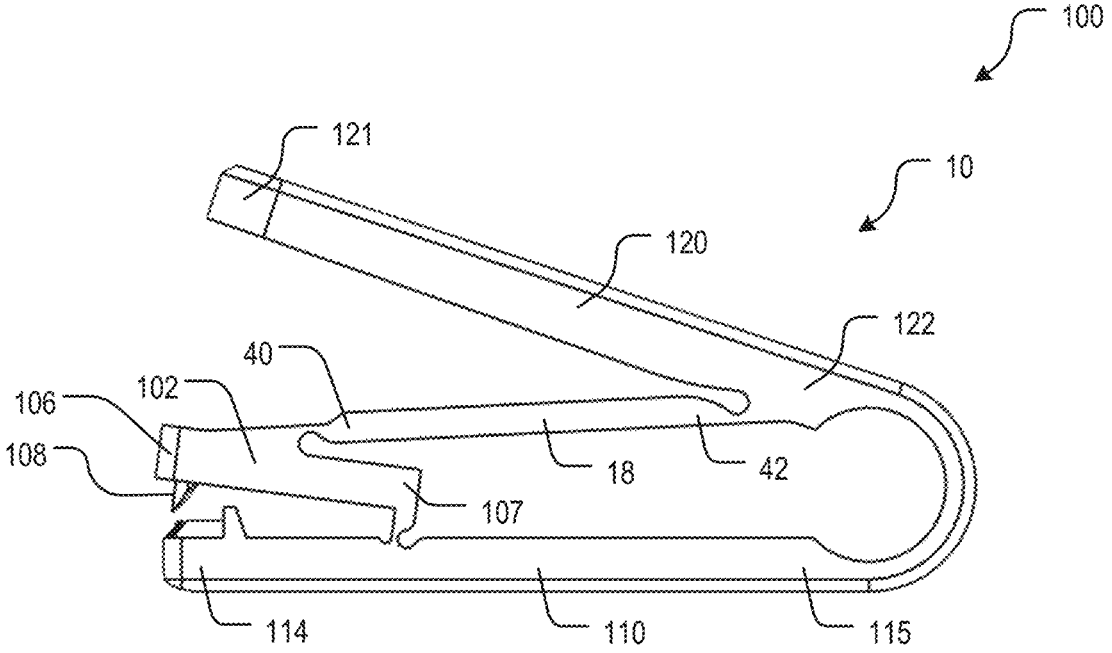
FIGS. 14A and 14B illustrate respective side views of the nail cutter including the compliant mechanism, according to an aspect of the present disclosure.
Figure 14B:
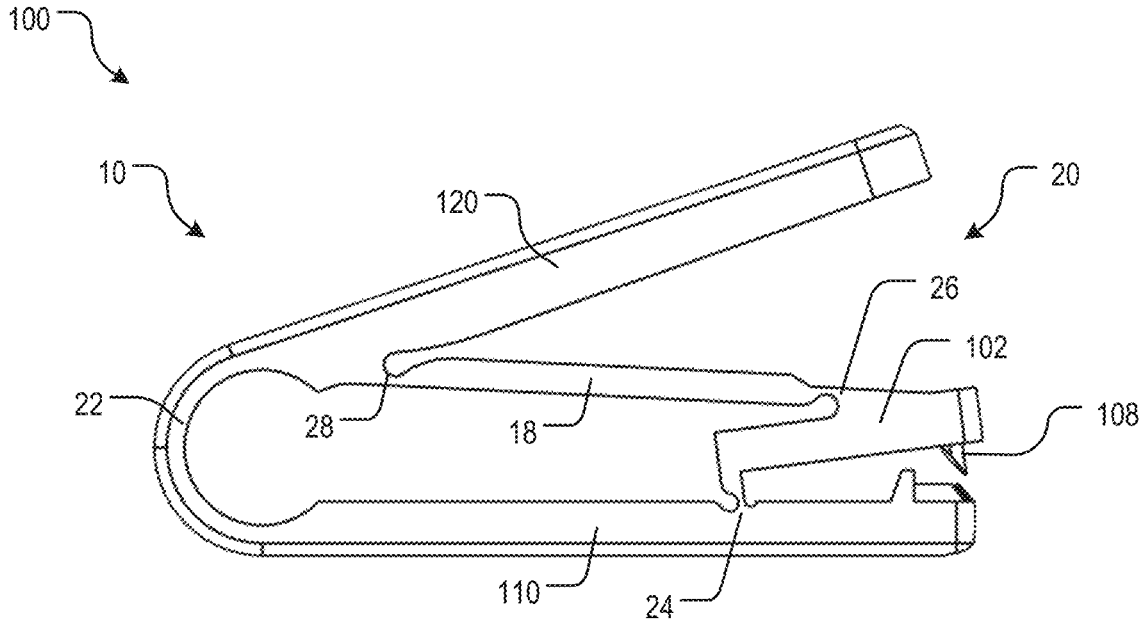
Figure 15:
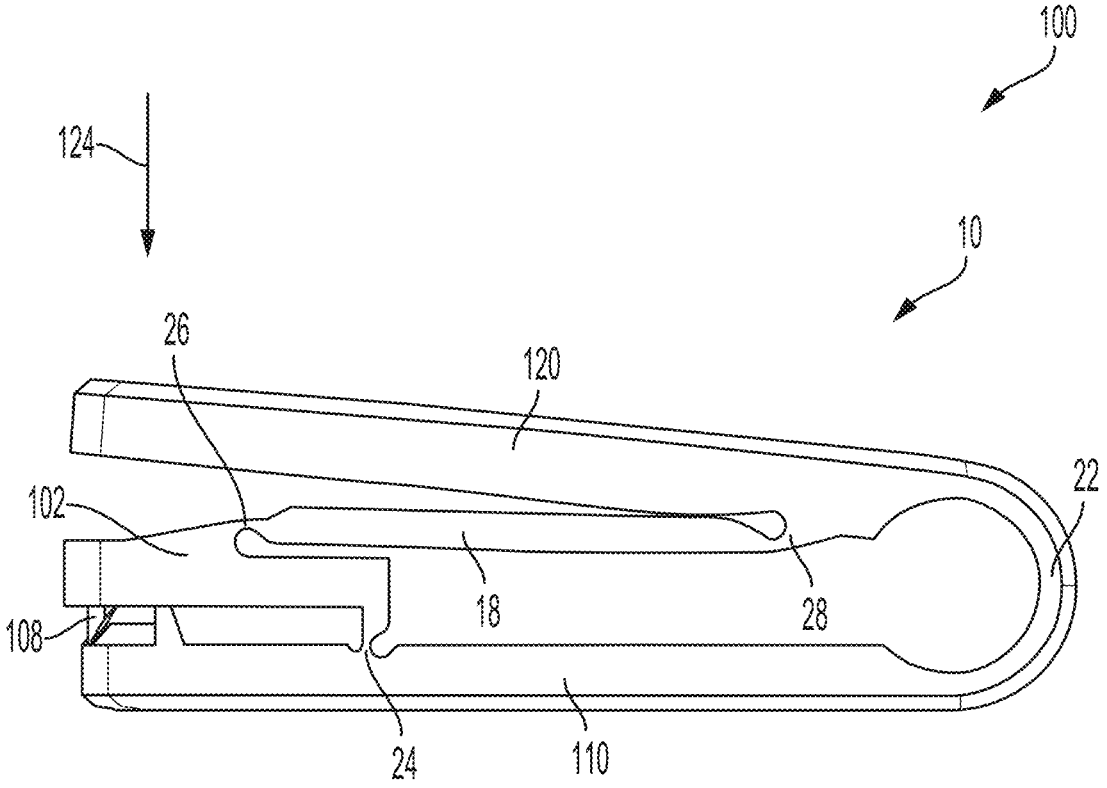
FIG. 15 illustrates a side view of the nail cutter including the compliant mechanism in a cutting position, according to an aspect of the present disclosure.

FIGS. 13-15 illustrate an example implementation of nail cutter 100 having the compliant mechanism. Cutting member 102 includes a first end portion 106 (e.g., proximal end) opposite a second end portion 107 (e.g., distal end). Opposing member 110 includes a first end portion 114 (e.g., proximal end) opposite a second end portion 115 (e.g., distal end). Lever 120 includes a first end portion 121 (e.g., proximal end) opposite a second end portion 122 (e.g., distal end). Connecting member 18 includes a first end portion 40 (e.g., proximal end) opposite a second end portion 42 (e.g., distal end).

In some aspects, opposing member 110 of the compliant mechanism embodiment of nail cutter 100 does not include a pre-formed recess 116. Rather, in these aspects, opposing member 110 includes a flat, or relatively flat, surface in which cutting edge 109 of blade 108 forms a recess as cutting edge 109 is brought into contact with opposing member 110 over time.

The second end portion 115 of opposing member 110 is integral with second end portion 122 of lever 120 via a flexible hinge 22 of the plurality of hinges 20. The second end portion 107 of the cutting member 102 is integral with a middle portion of the opposing member 110 via a flexible hinge 24 of the plurality of hinges 20. The middle portion of the opposing member 110 is disposed between the first end portion 114 and second end portion 115 of the opposing member 110. The first end portion 40 of the connecting member 18 is integral with a middle portion of the cutting member 102 via a flexible hinge 26 of the plurality of hinges 20. The middle portion of the cutting member 102 is disposed between the first end portion 106 and second end portion 107 of the cutting member 102. The second end portion 42 of the connecting member 18 is integral with the second end portion 122 of the lever 120 via a flexible hinge 28 of the plurality of hinges 20.

Lever 120 is movable between the disengaged position, shown in FIGS. 13, 14A, and 14B, and the engaged position, shown in FIG. 15, during a nail cutting operation. The plurality of flexible hinges 20 of unitary body 10 are configured and arranged such that when lever 120 is moved from the disengaged position to the engaged position, cutting member 102 is moved, relative to opposing member 110, from the open position to the cutting position. For example, as a user presses on lever 120 with a force component in the direction of arrow 124, unitary body 10 flexes at flexible hinges 22, 24, 26, 28 thereby forcing blade 108 to move towards the first end portion 114 of opposing member 110. For example, as the user presses on lever 120 during a nail cutting operation, flexible hinge 28 flexes towards opposing member 110, flexible hinge 26 flexes away from opposing member 110 and flexible hinge 24 flexes towards the first end portion 114, which causes blade 108 to move towards the first end portion 114.

The configuration of the plurality of flexible hinges 20 dictates the relative motion of blade 108 and the mechanical advantage provided at blade 108 by displacing the lever 120. For example, connecting member 18 is subjected to a greater magnitude of force than what is applied at the proximal end 121 of lever 120 due to the relative position of flexible hinge 28 between flexible hinge 22 and the proximal end 121 of the lever 120. In another example, an angle between connecting member 18 and lever 120, or a relative difference of an angle between connecting member 18 and opposing member 110 and an angle between lever 120 and opposing member 110, also impacts the amount of force transmitted through connecting member 18. At least some of the force transmitted through connecting member 18 is transferred to cutting member 102 via flexible hinge 26. Cutting member 102 converts at least some of that force into a force at blade 108, the magnitude of which is determined by the relative positions of blade 108, flexible hinge 26, and flexible hinge 24, and an angle between connecting member 18 and cutting member 102. The position of flexible hinge 24 relative to blade 108 also contributes to the motion of blade 108.

Various parameters of the configuration of the plurality of flexible hinges 20 can be altered to achieve different embodiments of nail cutter 100 that display different mechanical properties. For example, any of the following distances can be altered: a distance between blade 108 and flexible hinge 26, a distance between blade 108 and flexible hinge 24, a distance between flexible hinge 26 and flexible hinge 28, a distance between flexible hinge 24 and flexible hinge 26, and a distance between first end portion 121 of lever 120 and flexible hinge 28. The angles between two respective members of nail cutter 100 can also be altered. When referring to an angle between two members of nail cutter 100 herein, reference is made to an angle between planes extending through the lengths of each of the members.

In some aspects, the plurality of flexible hinges 20 of unitary body 10 are configured and arranged such that cutting edge 109 of blade 108 travels through a curved cutting path during a nail cutting operation. For example, flexion of the flexible hinges 24, 26, and 28 forces cutting edge 109 to travel through the curved cutting path.

Figure 16:
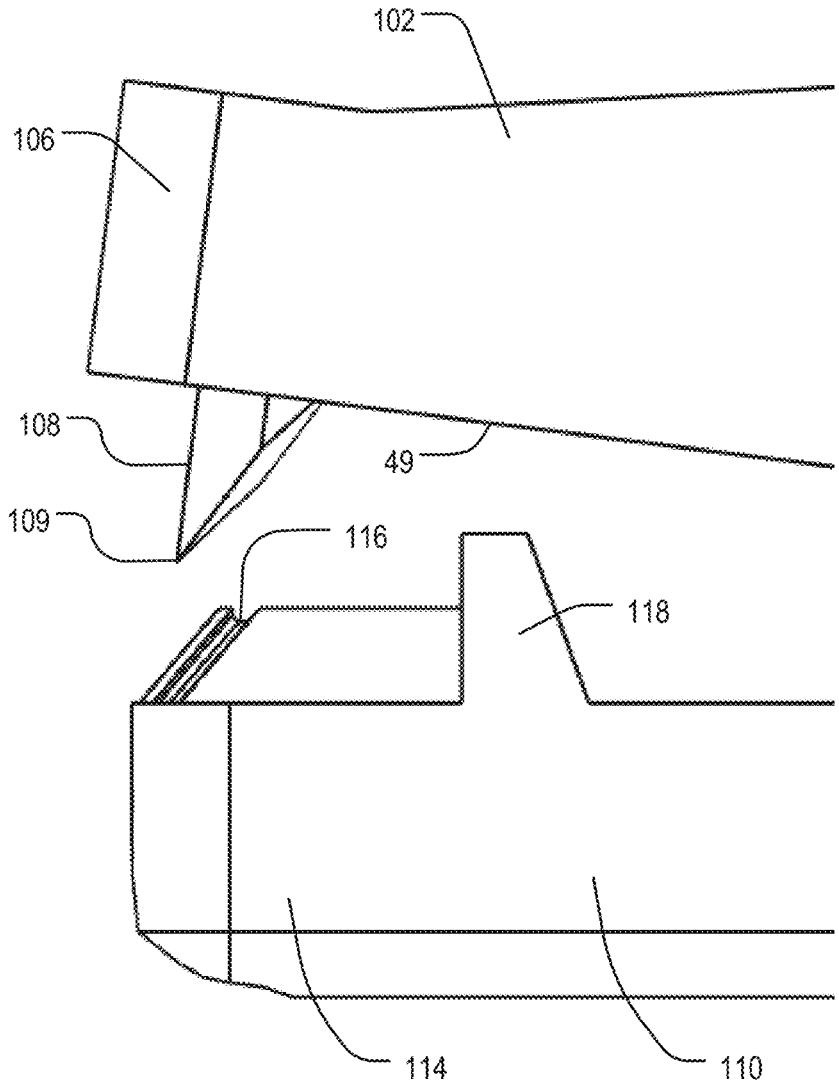
FIG. 16 illustrates a magnified view of a cutting end of the nail cutter including the complaint mechanism in an open position, according to an aspect of the present disclosure.
Figure 17:
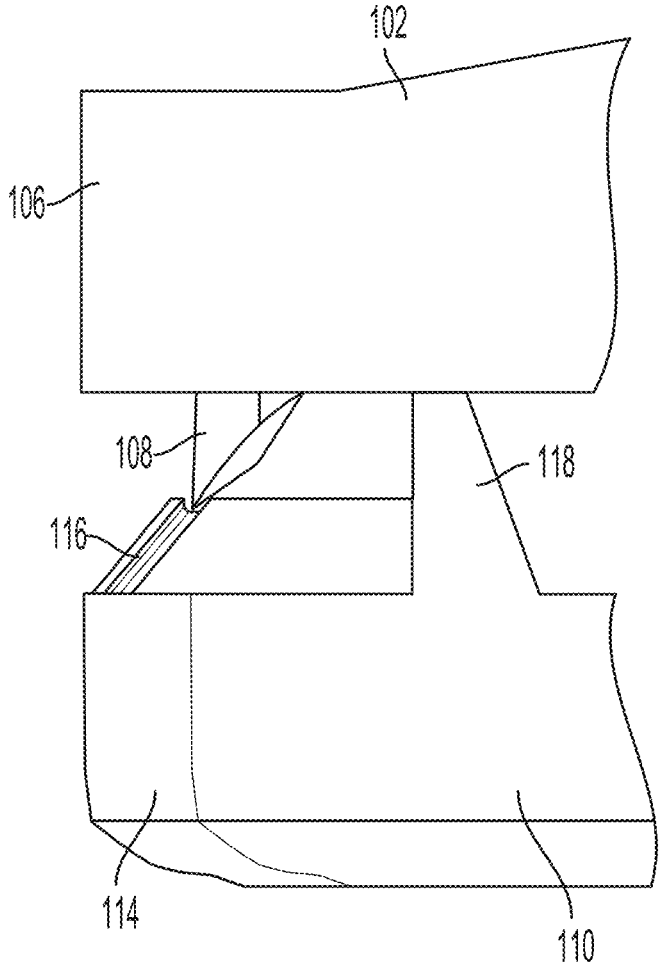
FIG. 17 illustrates a magnified view of a cutting end of the nail cutter including the complaint mechanism in the cutting position, according to an aspect of the present disclosure.

With reference to FIGS. 16 and 17, nail cutter 100 may include stop 118 (e.g., a protrusion) extending from opposing member 110 in some aspects. Stop 118 is structured such that as blade 108 is moved towards the first end portion 114 of opposing member 110, a surface 49 of cutting member 102 contacts stop 118 to limit how far cutting edge 109 can advance. For example, stop 118 may restrict cutting edge 109 from contacting opposing member 110. In another example, cutting edge 109 may contact opposing member 110, but stop 118 restricts cutting edge 109 from cutting through opposing member 110 or causing excessive damage to opposing member 110. For instance, in aspects in which opposing member 110 does not include a pre-formed recess 116, stop 118 controls a depth of the recess formed by blade 108.

As described above, blade 108 of nail cutter 100 may include, or be constructed entirely of, a different material than opposing member 110. In the embodiment of nail cutter 100 including the complaint mechanism, in which opposing member 110 is part of unitary body 10, blade 108 may include, or be constructed entirely of, a different material than unitary body 10. For example, a first material of blade 108 may have a greater hardness than a second material of unitary body 10. Example hardness ranges for the first material of blade 108 have been provided above.

Figure 18:
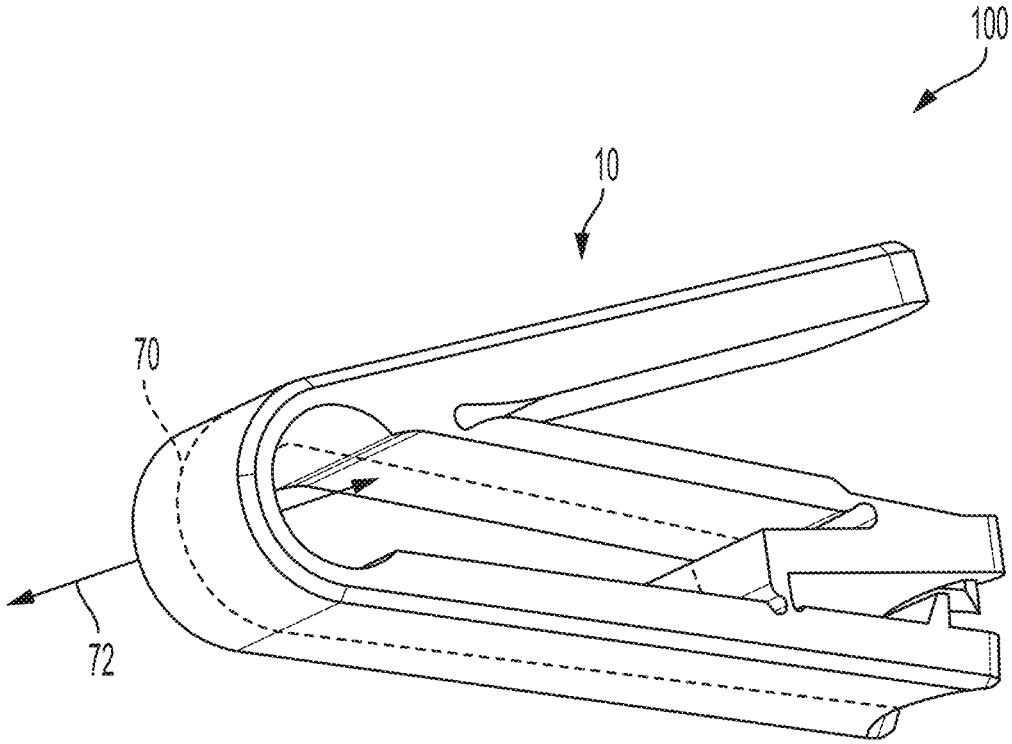
FIG. 18 illustrates a side-to-side mold draw direction of the nail cutter, according to an aspect of the present disclosure.

In various aspects, the entirety of unitary body 10 may be formed from the second material. For example, unitary body 10 may be formed from a mold. In such examples, with reference to FIG. 18, formation of unitary body 10 may include utilizing a two-dimensional side-view profile so that the mold draw direction is along the side-to-side direction of arrow 72. An example parting line 70 for the mold is also shown. In some aspects, unitary body 10 may be extruded and cut to width.

The second material of unitary body 10 may include a polymeric material. In one example, the polymeric material may be resin. In another example, the second material may include a glass-filled polymer (e.g., nylon).

In an alternative embodiment, multi-shot molding may be employed wherein various resins are utilized to form a single molded part. The part may be composed of either a singular molded material or a combination of molded materials, including but not limited to one resin or a combination of two or more resins.

Figure 11:
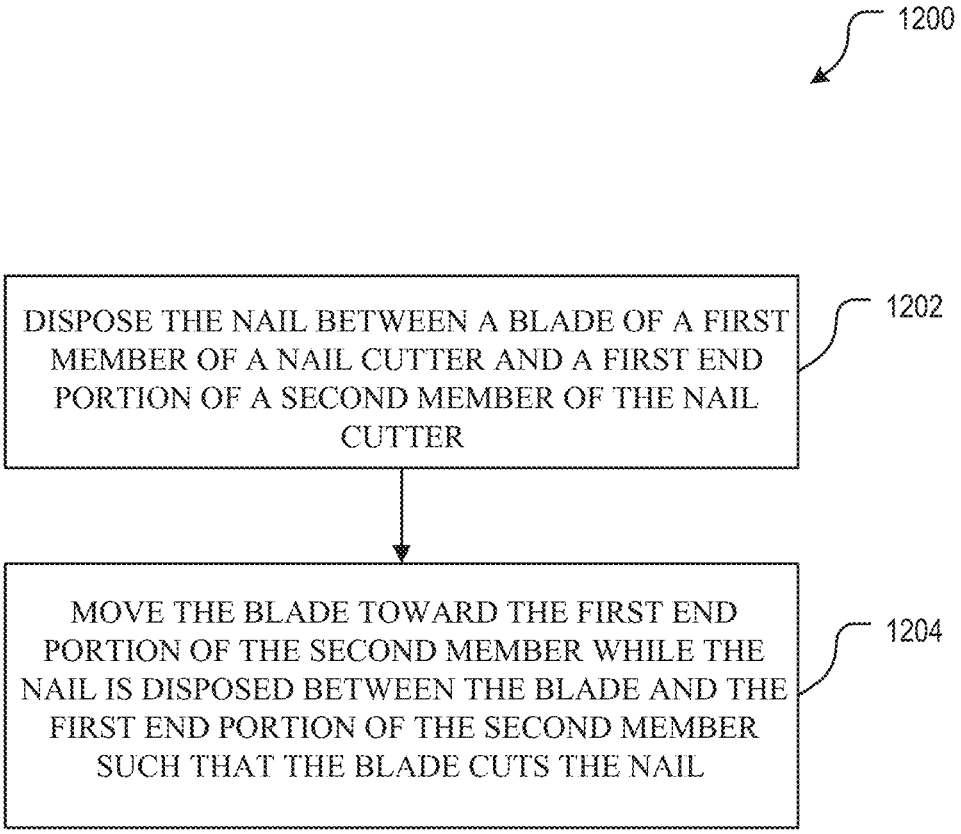
FIG. 11 illustrates a flow chart of an example method for cutting a nail, according to an aspect of the present disclosure.

FIG. 11 shows a flow chart of an example method for cutting a human nail. Although the example method 1200 is described with reference to the flow chart illustrated in FIG. 11, it will be appreciated that other methods of performing the acts associated with the method 1200 may be used. For example, additional blocks may be added and some of the blocks described may be omitted. Method 1200, at block 1202, includes disposing a nail between a blade (e.g., blade 108) of a first member (e.g., cutting member 102) of a nail cutter (e.g., nail cutter 100) and a first end portion (e.g., first end portion 114) of a second member (e.g., opposing member 110) of the nail cutter 100. The first end portion of the second member does not include a blade.

At block 1204, the blade is moved toward the first end portion of the second member while the nail is disposed between the blade and the first end portion of the second member such that the blade cuts the nail. In some aspects, moving the blade toward the first end portion of the second member comprises pressing a third member (e.g., lever 120) of the nail cutter. For example, moving the blade toward the first end portion of the second member may include pressing a first end portion (e.g., first end portion 121) of the third member of the nail cutter toward the first end portion of the second member. In at least some aspects, moving the blade toward the first end portion of the second member is performed such that a cutting edge (e.g., cutting edge 109) of the blade is received in a recess (e.g., recess 116) in the first end portion of the second member. In at least some aspects, moving the blade toward the first end portion of the second member is performed such that a cutting edge of the blade is prevented from contacting the second member. In some aspects, the nail that is cut may be received in a compartment (e.g., compartment 300) of the second member after the nail is cut. In some aspects, method 1200 includes releasably coupling the third member to the second member such that the third member overlies the compartment.

In one or more aspects, the present nail cutter and nail cutting method may include additional aspects, such as any single aspect or any combination of aspects described below or in connection with one or more other processes or devices described elsewhere herein. In a first aspect, a nail cutter includes a first member; a second member; and a third member. A first end portion of the first member includes a blade. The second member has a first end portion that does not include a blade, and is coupled to the first member such that the first member is movable relative to the second member between first and second positions. When the first member moves from the first position to the second position, the blade moves toward the first end portion of the second member. The third member is coupled to the first member and is movable between third and fourth positions. The third member is configured to move the first member, relative to the second member, from the first position to the second position when the third member moves from the third position to the fourth position.

In a second aspect, in combination with the first aspect, the first end portion of the second member includes a recess positioned to receive a cutting edge of the blade when the first member is in the second position.

In a third aspect, in combination with one or more of the first aspect or the second aspect, the second member comprises a stop configured so as to contact the first member and prevent a cutting edge of the blade from contacting the second member when the first member is in the second position.

In a fourth aspect, in combination with one or more of the first aspect through the third aspect, the blade comprises a first material; and the second member comprises a second material having a hardness that is lower than a hardness of the first material.

In a fifth aspect, in combination with one or more of the first aspect through the fourth aspect, the first material comprises a metal.

In a sixth aspect, in combination with one or more of the first aspect through the fifth aspect, the second material comprises a polymeric material.

In a seventh aspect, in combination with one or more of the first aspect through the sixth aspect, the first material comprises a metal and the second material comprises a polymeric material.

In an eighth aspect, in combination with one or more of the first aspect through the seventh aspect, the polymeric material comprises fibers dispersed in a polymeric matrix.

In a ninth aspect, in combination with the fourth aspect, the hardness of the first material is at least 55 HRC.

In a tenth aspect, in combination with one or more of the first aspect through the ninth aspect, the blade is integral with a body of the first member.

In an eleventh aspect, in combination with one or more of the first aspect through the tenth aspect, a cutting edge of the blade is curved in a first direction and in a second direction, wherein the first direction is perpendicular to the second direction.

In a twelfth aspect, in combination with one or more of the first aspect through the eleventh aspect, the third member is coupled to the first member such that a first end portion of the third member moves toward the first end portion of the second member while the third member moves from the third position to the fourth position.

In a thirteenth aspect, in combination with one or more of the first aspect through the twelfth aspect, a second end portion of the third member is pivotably coupled to a second end portion of the first member, and the first member is pivotably coupled to the second member at a location disposed between the first end portion of the second member and a second end portion of the second member.

In a fourteenth aspect, in combination with one or more of the first aspect through the thirteenth aspect, the blade is disposed further from a second end portion of the second member when the first member is in the second position than when the first member is in the first position.

In a fifteenth aspect, in combination with one or more of the first aspect through the fourteenth aspect, the second member defines a compartment configured to receive a nail cut between the blade and the first end portion of the second member.

In a sixteenth aspect, in combination with one or more of the first aspect through the fifteenth aspect, the third member is movable to a fifth position in which the third member is releasably coupled to the second member.

In a seventeenth aspect, in combination with one or more of the first aspect through the sixteenth aspect, the second member defines a compartment configured to receive a nail cut between the blade and the first end portion of the second member, and the third member is movable to a fifth position in which the third member is releasably coupled to the second member and overlies the compartment.

In an eighteenth aspect, in combination with one or more of the first aspect through the seventeenth aspect, a method of cutting a nail of a human includes disposing the nail between a blade of a first member of a nail cutter and a first end portion of a second member of the nail cutter, wherein the first end portion of the second member does not include a blade; and moving the blade toward the first end portion of the second member while the nail is disposed between the blade and the first end portion of the second member such that the blade cuts the nail.

In a nineteenth aspect, in combination with the eighteenth aspect, moving the blade toward the first end portion of the second member is performed such that a cutting edge of the blade is received in a recess in the first end portion of the second member.

In a twentieth aspect, in combination with one or more of the eighteenth aspect through the nineteenth aspect, moving the blade toward the first end portion of the second member is performed such that a cutting edge of the blade is prevented from contacting the second member.

In a twenty-first aspect, in combination with one or more of the eighteenth aspect through the twentieth aspect, the blade comprises a metal having a hardness that is at least 55 HRC, and the second member comprises a polymeric material.

In a twenty-second aspect, in combination with one or more of the eighteenth aspect through the twenty-first aspect, moving the blade toward the first end portion of the second member comprises pressing a third member of the nail cutter.

In a twenty-third aspect, in combination with one or more of the eighteenth aspect through the twenty-second aspect, the nail that is cut is received in a compartment of the second member after the nail is cut.

In a twenty-fourth aspect, in combination with one or more of the eighteenth aspect through the twenty-third aspect, the method comprises releasably coupling the third member to the second member such that the third member overlies the compartment.

In a twenty-fifth aspect, in combination with one or more of the eighteenth aspect through the twenty-fourth aspect, moving the blade toward the first end portion of the second member comprises pressing a third member of the nail cutter. The nail that is cut is received in a compartment of the second member after the nail is cut, and the method comprises releasably coupling the third member to the second member such that the third member overlies the compartment.

In a twenty-sixth aspect, in combination with one or more of the eighteenth aspect through the twenty-fifth aspect, moving the blade toward the first end portion of the second member comprises pressing a first end portion of a third member of the nail cutter toward the first end portion of the second member.

In a twenty-seventh aspect, which may be combined with one or more of the eighteenth aspect through the twenty-sixth aspect, a nail cutter includes a blade and a unitary body. The blade includes a cutting edge. The unitary body includes a first member, a second member, a third member, and a plurality of flexible hinges. The blade extends from a proximal end of the first member. A proximal end of the second member is disposed opposite the cutting edge of the blade. The plurality of flexible hinges are configured such that, when a proximal end of the third member is transitioned from a first position to a second position, the unitary body flexes at the plurality of flexible hinges so as to decrease a distance between the cutting edge and the proximal end of the second member.

In a twenty-eighth aspect, in combination with the twenty-seventh aspect, a distal end of the second member is joined to a distal end of the third member by a first flexible hinge of the plurality of flexible hinges.

In a twenty-ninth aspect, in combination with the twenty-seventh aspect or the twenty-eighth aspect, a distal end of the first member is joined to a middle portion of the second member between the proximal and distal ends of the second member by a second flexible hinge of the plurality of flexible hinges.

In a thirtieth aspect, in combination with one or more of the twenty-seventh aspect through the twenty-ninth aspect, the unitary body further includes a fourth member. A proximal end of the fourth member is joined to a middle portion of the first member between the proximal and distal ends of the first member by a third flexible hinge of the plurality of flexible hinges.

In a thirty-first aspect, in combination with the thirtieth aspect, a distal end of the fourth member is joined to the distal end of the third member by a fourth flexible hinge of the plurality of flexible hinges.

In a thirty-second aspect, in combination with one or more of the twenty-seventh aspect through the thirty-first aspect, the blade includes a first material and the unitary body includes a second material different than the first material.

In a thirty-third aspect, in combination with the thirty-second aspect, the first material has a greater hardness than the second material.

In a thirty-fourth aspect, in combination with the thirty-second aspect, the first material comprises a metal, and the second material comprises a polymeric material.

In a thirty-fifth aspect, in combination with one or more of the twenty-seventh aspect through the thirty-fourth aspect, the blade is integral with the unitary body.

In a thirty-sixth aspect, in combination with one or more of the twenty-seventh aspect through the thirty-fifth aspect, the blade is the only blade extending from the unitary body.

In a thirty-seventh aspect, in combination with one or more of the twenty-seventh aspect through the thirty-sixth aspect, the proximal end of the second member includes a recess configured to receive the cutting edge of the blade.

In a thirty-eighth aspect, in combination with one or more of the twenty-seventh aspect through the thirty-seventh aspect, the second member includes a protrusion configured to contact the first member so as to prevent contact between the cutting edge and the proximal end of the second member when the proximal end of the third member is in the second position.

In a thirty-ninth aspect, in combination with one or more of the twenty-seventh aspect through the thirty-eighth aspect, the hardness of the blade is at least 55 HRC.

In a fortieth aspect, in combination with one or more of the twenty-seventh aspect through the thirty-ninth aspect, the cutting edge of the blade is curved in a first direction and in a second direction. The first direction is perpendicular to the second direction.

In a forty-first aspect, which may be combined with one or more of the eighteenth aspect through the twenty-sixth aspect, a nail cutter includes a unitary body. The unitary body includes a first member, a second member, a third member, a fourth member, and a plurality of flexible hinges including a first flexible hinge, a second flexible hinge, a third flexible hinge, and a fourth flexible hinge. The second member is joined to the third member by the first flexible hinge. The first member is joined to the second member by the second flexible hinge. The fourth member is joined to the first member by the third flexible hinge. And the fourth member is joined to the third member by the fourth flexible hinge.

In a forty-second aspect, in combination the forty-first aspect, a distal end of the second member is joined to a distal end of the third member by the first flexible hinge, and a distal end of the first member is joined to a middle portion of the second member between the distal end of the second member and a proximal end of the second member by the second flexible hinge.

In a forty-third aspect, in combination with the forty-first aspect or the forty-second aspect, a proximal end of the fourth member is joined to a middle portion of the first member between a distal end of the first member and a proximal end of the first member by the third flexible hinge, and a distal end of the fourth member is joined to the distal end of the third member by the fourth flexible hinge.

In a forty-fourth aspect, in combination with one or more of the forty-first aspect through the forty-third aspect, the unitary body is configured such that transitioning the third member from a first position to a second position causes flexion in each of the first, second, third, and fourth flexible hinges.

In a forty-fifth aspect, in combination with the forty-fourth aspect, the first flexible hinge joins a distal end of the second member and a distal end of the third member, and transitioning the third member from the first position to the second position includes decreasing a distance between a proximal end of the second member and a proximal end of the third member.

In a forty-sixth aspect, in combination with one or more of the forty-first aspect through the forty-fifth aspect, the nail cutter further includes a single blade. The single blade is coupled to, or integral with, the unitary body.

All numerical ranges herein should be understood to include all integers, whole or fractions, within the range, inclusive of the ends of the ranges. Moreover, these numerical ranges should be construed as providing support for a claim directed to any number or subset of numbers in that range. For example, a disclosure of from 1 to 10 should be construed as supporting a range of from 1 to 8, from 3 to 7, from 1 to 9, from 3.6 to 4.6, from 3.5 to 9.9, and so forth.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

The above specification provides a complete description of the structure and use of illustrative embodiments of this disclosure. Although certain embodiments have been described above with a certain degree of particularity, or with reference to one or more individual embodiments, the scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, feature, functions, operations, or steps, any of these embodiments may include any combination or permutation of any of the components, elements, features, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative. Additionally, although this disclosure describes or illustrates particular embodiments as providing particular advantages, particular embodiments may provide none, some, or all of these advantages.

The invention is claimed as follows:

1. A nail cutter comprising:

a first member, wherein a first end portion of the first member includes a blade, wherein the blade includes a cutting edge; and a second member including a stop, wherein:

a first end portion of the second member does not include a blade;

the second member is coupled to the first member such that the first member is movable relative to the second member between first and second positions, wherein when the first member moves from the first position to the second position, the blade of the first member moves toward the first end portion of the second member; and the stop is configured to contact the first member and prevent the cutting edge of the blade of the first member from contacting the second member when the first member is in the second position.

2. The nail cutter of claim 1, further comprising:

a third member that is coupled to the first member and is movable between third and fourth positions, wherein the third member is configured to move the first member, relative to the second member, from the first position to the second position when the third member moves from the third position to the fourth position.

3. The nail cutter of claim 1, wherein the stop comprises a first protrusion and a second protrusion, wherein the first and second protrusions extend from opposite sides of the second member and are configured to cooperate with each other to limit advancement of the cutting edge of the blade.

4. The nail cutter of claim 1, wherein:

the blade of the first member comprises a first material; and the second member comprises a second material having a hardness that is lower than a hardness of the first material.

5. The nail cutter of claim 4, wherein:

the first material comprises a metal; and the second material comprises a polymeric material.

6. The nail cutter of claim 5, wherein the polymeric material comprises fibers dispersed in a polymeric matrix.

7. The nail cutter of claim 1, wherein the first end portion of the second member comprises resin.

8. The nail cutter of claim 4, wherein the hardness of the first material is at least 55 HRC.

9. The nail cutter of claim 1, wherein the blade of the first member is integral with a body of the first member.

10. The nail cutter of claim 1, wherein:

the cutting edge of the blade of the first member is curved in a first direction and in a second direction, wherein the first direction is perpendicular to the second direction.

11. The nail cutter of claim 2, wherein the third member is coupled to the first member such that a first end portion of the third member moves toward the first end portion of the second member while the third member moves from the third position to the fourth position.

12. The nail cutter of claim 11, wherein:

a second end portion of the third member is pivotably coupled to a second end portion of the first member; and the first member is pivotably coupled to the second member at a location disposed between the first end portion of the second member and a second end portion of the second member.

13. The nail cutter of claim 1, wherein the second member is coupled to the first member such that the blade of the first member is disposed closer to a second end portion of the second member when the first member is in the second position than when the first member is in the first position.

14. A nail cutter comprising:

a first member, wherein a first end portion of the first member includes a blade, wherein the blade includes a cutting edge; and a second member including a stop, wherein the stop is configured to contact the first member and prevent the cutting edge of the blade of the first member from contacting the second member when moving the blade of the first member toward a first end portion of the second member, wherein:

the first end portion of the second member does not include a blade;

the second member is coupled to the first member such that the first member is movable relative to the second member between first and second positions, wherein when the first member moves from the first position to the second position, the blade of the first member moves toward the first end portion of the second member; and a third member that is coupled to the first member and is movable between third and fourth positions, wherein the third member is configured to move the first member, relative to the second member, from the first position to the second position when the third member moves from the third position to the fourth position, wherein:

the second member defines a compartment configured to receive a nail cut between the blade of the first member and the first end portion of the second member; and the third member is coupled to the second member and movable to a fifth position such that the third member overlies the compartment.

15. The nail cutter of claim 14, wherein the stop comprises a first protrusion and a second protrusion, wherein the first and second protrusions extend from opposite sides of the second member and are configured to cooperate with each other to limit advancement of the cutting edge of the blade.

16. A method of cutting a nail of a human, the method comprising:

disposing the nail between a blade of a first member of a nail cutter and a first end portion of a second member of the nail cutter, wherein the first end portion of the second member does not include a blade; and moving the blade of the first member toward the first end portion of the second member while the nail is disposed between the blade of the first member and the first end portion of the second member such that the blade of the first member cuts the nail, wherein:

the second member comprises a stop configured to contact the first member and prevent the cutting edge of the blade of the first member from contacting the second member when moving the blade of the first member toward the first end portion of the second member;

moving the blade of the first member toward the first end portion of the second member comprises pressing a third member of the nail cutter toward the first end portion of the second member;

the nail that is cut is received in a compartment of the second member after the nail is cut; and the third member is coupled to the second member such that the third member overlies the compartment.

17. The method of claim 16, wherein the stop comprises a first protrusion and a second protrusion, wherein the first and second protrusions extend from opposite sides of the second member and are configured to cooperate with each other to limit advancement of the cutting edge of the blade.

18. The method of claim 16, wherein:

the blade of the first member comprises a metal having a hardness that is at least 55 HRC; and the second member comprises a polymeric material.

19. The method of claim 16, wherein:

the cutting edge of the blade of the first member is curved in a first direction and in a second direction, wherein the first direction is perpendicular to the second direction.

20. The method of claim 16, wherein the stop is structured to control a depth of a recess formed in the second member by the cutting edge of the blade.

* * * * *